United States Patent [19]

Graul et al.

[11] Patent Number: 4,730,777

[45] Date of Patent: Mar. 15, 1988

[54] METHOD AND APPARATUS FOR WINDING RING CORES, RING COILS, RING CORE PARTS OR RING COIL PARTS

[75] Inventors: Otto Graul, Bamberg; Michael Dressel, Burgebrach, both of Fed. Rep. of Germany

[73] Assignee: MWB Messwandler-Bau Aktiengesellschaft, Bamberg, Fed. Rep. of Germany

[21] Appl. No.: 760,061

[22] Filed: Jul. 29, 1985

[30] Foreign Application Priority Data

Aug. 16, 1984 [DE] Fed. Rep. of Germany ..... 3430055

[51] Int. Cl.[4] ..... B65H 81/02

[52] U.S. Cl. ..... 242/4 R; 242/7.03

[58] Field of Search ..... 242/7.03 R, 4 R, 6, 242/7.08; 156/185, 422, 425, 397

[56] References Cited

U.S. PATENT DOCUMENTS

| | | | |
|---|---|---|---|
| 2,819,850 | 1/1958 | Mathis | 242/4 R |
| 2,820,598 | 1/1958 | Aveni | 242/4 R |
| 3,128,955 | 4/1964 | Stutz | 242/4 R |
| 3,239,153 | 3/1966 | Halacsy | 242/4 R |
| 4,553,705 | 11/1985 | Uchida et al. | 242/4 R |
| 4,568,032 | 2/1986 | Ishida et al. | 242/4 R |

FOREIGN PATENT DOCUMENTS

| | | |
|---|---|---|
| 1614712 | 12/1970 | Fed. Rep. of Germany . |
| 149442 | 8/1981 | Fed. Rep. of Germany . |

*Primary Examiner*—Stuart S. Levy
*Assistant Examiner*—Joseph J. Hail, III
*Attorney, Agent, or Firm*—Barnes & Thornburg

[57] ABSTRACT

A method and apparatus for winding ring cores, ring coils, ring core parts or ring coil parts, especially of ring core transformers or ring core measuring transformers, whereby the arrangement includes a winding material storage unit (33) which is moved alternately by means of two transfer mechanisms (20, 21) a distance about the ring core (5). Winding material 51 present on a supply roller (50) is thereby reeled off and wound on the ring core (5). The transfer mechanisms (20, 21) thereby move equally but in opposite directions between two transfer places (U 1, U 2) and are coupled respectively decoupled thereat with respective transfer mechanisms (20, respectively 21). The winding material storage unit (33) is thereby guided as structural unit during each winding through the ring core opening (7) of the ring core (5) respectively ring coil or the like.

32 Claims, 8 Drawing Figures

METHOD AND APPARATUS FOR WINDING RING CORES, RING COILS, RING CORE PARTS OR RING COIL PARTS

The present invention relates to a method and to an apparatus for winding ring cores, ring coils, ring core parts or ring coil parts.

Methods and apparatus are known in the prior art in which a ring core, for example, the iron core of a ring core transformer, is wound by means of a winding material storage device constructed as open ring in that the ring of the winding material storage device surrounds the ring core and during the rotation about its own axis winds the winding material stored on the same on the ring core. Such types of winding material storage rings, however, can be used only if the length of the ring core is not very large, i.e., if the cross section thereof is at least approximately square or if the ring core diameter is particularly large. Maximally, the ring core length, however, can amount at most only to approximately the diameter of the storage ring and the interior width of the ring core must correspond to at least the radius of the storage ring. Thus, at most a ring core can be wound with such an arrangement whose length is about twice as large as its interior width.

The task to be solved by the present invention is to provide a method and an apparatus suitable therefor, by means of which ring cores, ring coils, ring core parts or ring coil parts can be wound whose length amounts to a multiple of their interior width. Especially the present invention is to be suitable also as solution to the task to wind ring cores or ring coils with small interior width, respectively, with small opening cross section. The underlying problems are solved according to the present invention in that a winding material storage unit is used whose dimensions are smaller than the ring opening and which can be moved as structural unit through the ring opening, in that the winding material storage unit is moved about the ring core, ring coil or the like, the winding material storage unit is transferred alternately from a first transfer mechanism to at least a second transfer mechanism, the transfer mechanisms move toward one another, the winding material storage unit is then transferred at a first transfer place from the first to the second transfer mechanism, subsequently the transfer mechanisms move away from one another whereby the second transfer mechanism carrying the winding material storage unit is so moved in the winding direction at a distance from the ring core that the winding material storage unit rolls off along the ring core and the winding material is thereby wound off from the winding material storage unit and wound on the ring core, and that at the same time the first transfer mechanism moves opposite the winding direction toward the second transfer mechanism and both approach in a second transfer place, in that in the second transfer place the winding material storage unit is taken over by the first transfer mechanism and is continued to be moved in the winding direction at a distance from the ring core in such a manner that the winding material storage unit continues to roll off along the ring core and the winding material is thereby continued to be wound off the winding material storage unit and wound on the ring core, in that the second transfer mechanism moves simultaneously opposite the winding direction along the ring core, however, possibly at a distance therefrom, toward the first transfer place and in that this entire operation repeats itself until the number of windings to be applied is reached, whereby possibly the ring core is rotated about its central axis relative to the transfer mechanisms.

In the method according to the present invention, respectively, in the apparatus according to the present invention, the length of the ring core to be wound, of the ring coil to be wound, or of the ring core parts or ring coil parts to be wound is limited only by the length of the transfer mechanism, respectively, transfer mechanisms.

These and other objects, features and advantages of the present invention will become more apparent from the following description when taken in connection with the accompanying drawing which shows, for purposes of illustration only, one embodiment in accordance with the present invention, and wherein.

Figure 1:
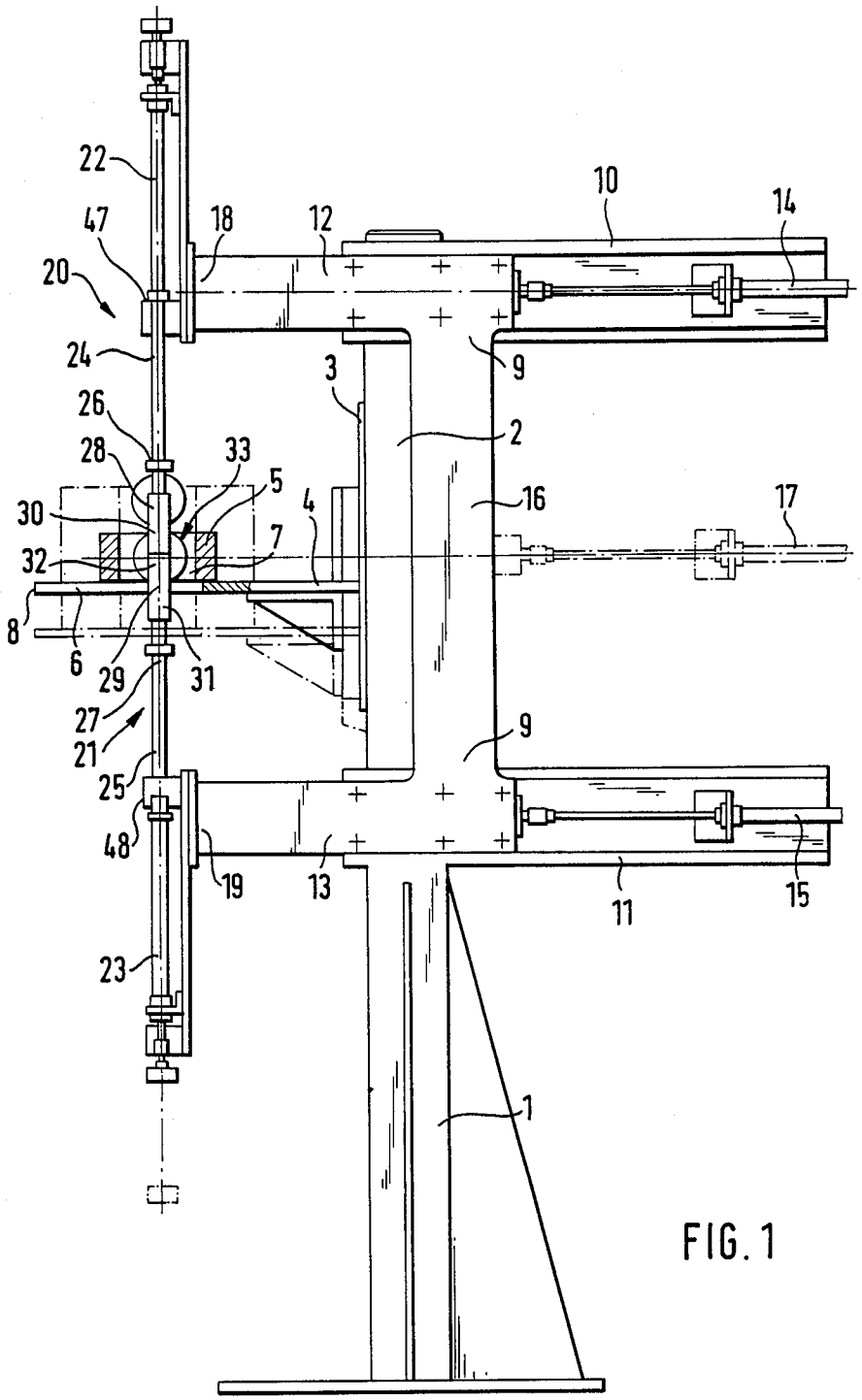
FIG. 1 is a somewhat schematic side elevational view of an installation in accordance with the present invention.
Figure 2A:
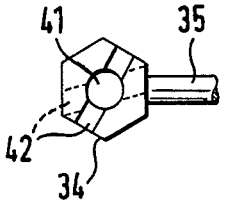
FIG. 2 is an elevational view on the winding material storage unit with a bayonet coupling and with the transfer couplings as viewed in the direction on the end surface of a roller.
Figure 3:
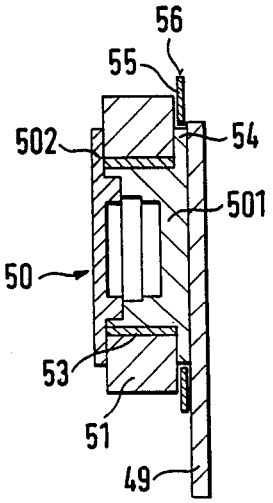
Figure 2:
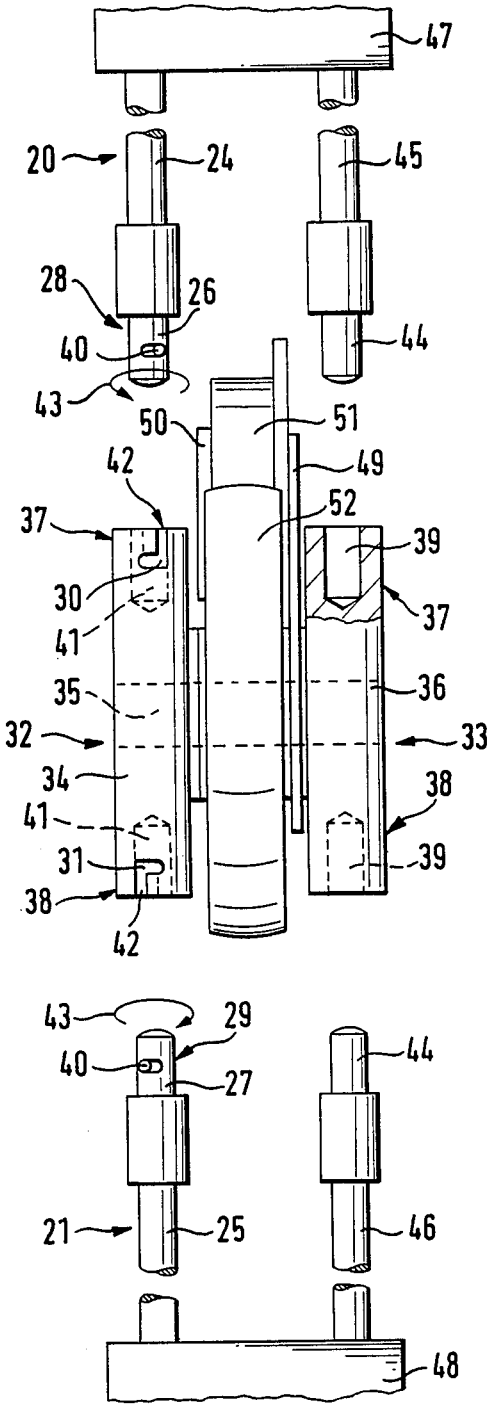
Figure 8:
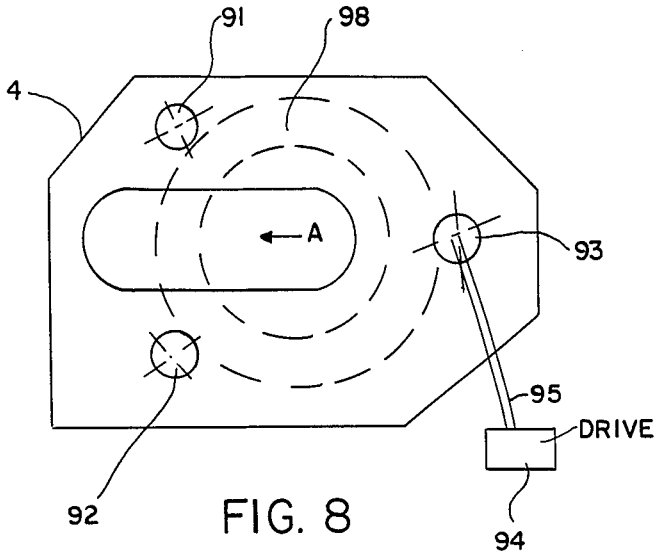

FIG. 2*a* is a plan view on the support member of the winding material storage unit according to FIG. 2;

FIG. 3 is a cross-sectional view through a supply roller in accordance with the present invention;

FIGS. 4 to 7 are somewhat schematic views illustrating the method in accordance with the present invention in different stages thereof taken from the backside of FIG. 1 looking outwardly of the figure; and FIG. 8 is a schematic in plan view of the mechanism used to rotate the ring core.

Referring now to the drawing wherein like reference numerals are used throughout the various views to designate like parts, and more particularly to FIG. 1, a support arm 2 which is provided on a pedestal 1, includes a support surface 3 constructed in particular as carriage bed. A support table 4 is arranged at the support surface 3 in particular adjustable along the support arm 2 and adapted to be fixed in predetermined adjusted positions. A ring core constructed, for example, as coil body or iron core body to be wound, is clamped fast on the support table 4 or is secured thereon in any other suitable manner. The support table 4 is provided with an aperture 6 whose depth extends at least approximately over the diameter of the ring opening 7, i.e., over the internal width of a ring core 5 and splits the support table 4 on one side, in the illustrated embodiment, at the left end side 8.

Supports 10 and 11 are attached to the ends 9 of the support arm 2 in particular perpendicularly to the support arm 2. One support column 12, 13 is displaceably supported in or at these supports 10 and 11 displaceable in the axial direction of the supports 10 and 11, i.e., perpendicularly to the support arm 2. The support columns 12 and 13 are each adjustable by way of a respective adjusting drive 14 and 15. Possibly the support columns 12 and 13 can be rigidly coupled with one another by a connecting web 16. The support columns 12 and 13 can therefore also be adjusted perpendicularly to the support arm 2 by a common adjusting drive 17 engaging centrally at the connecting web 16. This common adjustment can be used with or without the individual adjustment mechanisms 14,15.

At the free ends 18 and 19 of the support columns 12 and 13, one transfer mechanism generally designated by reference numeral 20 and 21 is displaceably supported at the support arm 2 displaceable perpendicularly to the support columns 12 and 13, i.e., parallelly to the support surface 3. Each transfer mechanism 20, 21 is adjustable by way of its own adjusting drive 22, 23. The transfer mechanisms 20 and 21 consist in the illustrated embodiment of one rod 24 and 25 coupled with the associated adjusting drive 22 and 23, at the free ends 26 and 27 of which is provided one transfer coupling 28, 29 each. The latter is adapted to be coupled with a counter-coupling part 30, respectively, 31 of a carrier 32 of a winding material storage unit generally designated by reference numeral 33.

For purposes of an improved positional fixation, especially in order to prevent a tilting of the carrier 32 on a transfer coupling 28 or 29, the carrier 32 consists of a support body 34 (FIG. 2) arranged perpendicularly in the plane of the drawing and therefore not visible, of a rotating shaft 35 secured at the support body 34 and extending perpendicularly thereto and of a second support body 36 rigidly secured at the free end of the rotating shaft 35. The counter-coupling parts 30 and 31 are provided in the first support body 34 at diametrally opposite places 37 and 38 with respect to the shaft 35. Correspondingly arranged position-fixing elements 39 in the form of apertures and/or raised portions, in the illustrated embodiment in the form of bores, are provided in the second support body 36.

As shown in FIG. 2, the coupling between the rods 24 and 25 and the carrier 32 consists of bayonet connections whereby laterally projecting pins 40 are provided in the rod end and bores 41 and the angular bayonet slots 42 are provided in the support body 34. The coupling takes place by insertion of the rod end into the bore 41 and subsequent rotation of the rod 24, respectively, 25 in the direction of the arrow 43.

This rotation can occur by any conventional means well known to one skilled in the art. Oscillating drives from axially moveable shafts are known in the art as evidenced by STUTZ, U.S. Pat. No. 3,128,955, which shows for example in FIG. 4 a motor 30 provided to rotate a shaft which is actually shifted. Other conventional drive mechanisms could also be utilized. All that is needed is a drive mechanism that can oscillate which is attached to a shaft that is axial shiftable.

The positional fixing of the carrier 32 of the winding material storage unit 33 takes place by insertion of the ends 44 of fixing rods 45 and 46 into bores 39 of the second support body 36. The fixing rod 45, respectively, 46 is rigidly connected with the rod 24, respectively, 25 by way of a guide head 47, respectively, 48 connected with the adjusting drive 22, respectively, 23 and the support column 12, respectively, 13.

A guide lever 49 is rotatably supported on the shaft 35. The guide lever 49 serves for the retention of a supply roller generally designated by reference numeral 50 for a winding material 51 (FIGS. 2 and 3) which is either rigidly or rotatably supported at the one end of the guide lever 49. On the other hand, the guide lever 49 also serves for the retention of a pressure roller 52 (FIG. 2) rotatably supported thereon, when the pressure roller is not supported directly on the shaft 35, as is the case in the illustrated embodiments. Possibly, the pressure roller 52 may also be arranged on the part of the guide lever 49 extended beyond the shaft 35. The supply roller 50 and the pressure roller 52 are thereby so arranged in the illustrated embodiment that the former is located at a further distance from the shaft 35 than the pressure roller 52. If in lieu of the two rollers 50 and 52, only a single supply roller 50 is used, then the latter forms at the same time the pressure roller and is then itself supported on the shaft 35.

The supply roller 50 can be constructed two-partite as shown in FIG. 3, whereby the one part 501 is held fixedly or rotatably at the guide lever 49 and the other part 502 is adapted to be screwed into the first part 501 or both parts 501 and 502 are adapted to be connected with each other in any other known manner, for example, by a springy clamping member. As a result of this construction, a sleeve 53, on which is wound winding material 51, can be easily and rapidly mounted over the supply roller 50 and can be kept in correct position.

A washer disk 55 is provided on a flange side adjacent to or on the roller flange 54 of the supply roller 50. The washer disk 55 may also be formed by the roller flange 54 itself. Preferably, the roller flange 54, respectively, the washer disk 55 or at least the edge 56 thereof consists of material which has a low coefficient of friction such as, for example, brass, polyamide, Teflon, or the like. The washer disk 55 is also rotatably mounted so that during abutment at the ring core 5 during the winding operation, no large amount of friction occurs.

Figure 4:
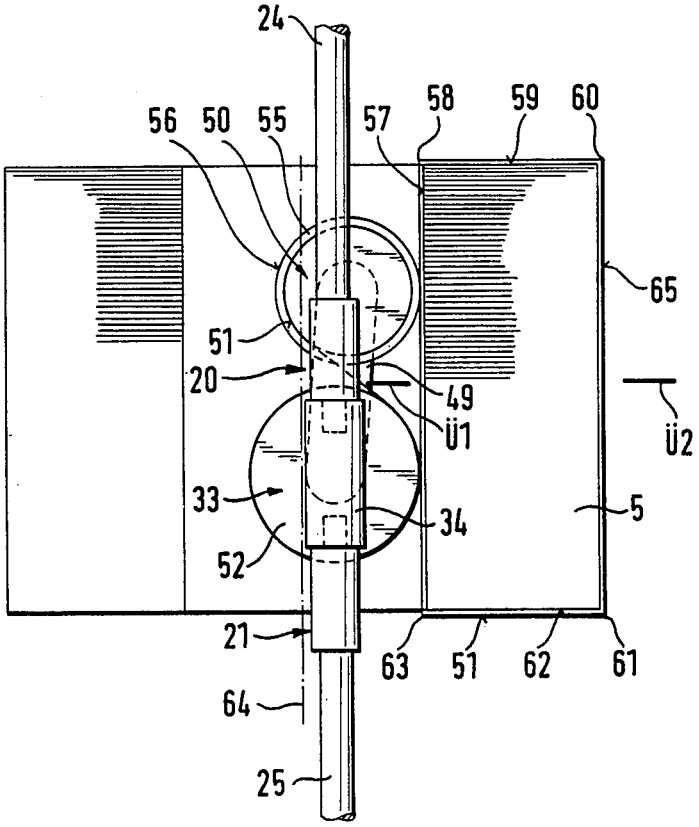

The winding method according to the present invention to be described hereinafter is carried out with the installation described hereinabove as follows:

In FIG. 4 the installation is illustrated at the instant of the transfer of the winding material storage unit 33 from the lower transfer mechanism 21 to the upper transfer mechanism 20. Prior thereto the lower transfer mechanism 21 had been moved upwardly and the upper transfer mechanism 20 had been moved downwardly whereby the winding material storage unit 33 was coupled with the lower transfer mechanism 21. Both transfer mechanisms 20 and 21 are therefore in a first transfer place U1. After the insertion of the transfer coupling 28 into the counter coupling 30 of the carrier body 34 and with a bayonet coupling after the rotation of the rod 24, the winding material storage unit 33 is coupled with the transfer mechanism 20. At the same time or subsequently the lower transfer mechanism 21 is decoupled by from the carrier body 34 by rotation of the rod 25 in the opening direction.

Thereupon the upper transfer mechanism 20 is moved upwardly and the lower transfer mechanism 21 downwardly. The rods 24 and 25 are moved by the adjusting drives 14 and 15 respectively by the adjusting drive 17 so far toward the right that the pressure roller 52 abuts at the inner wall 57 of the ring core 5, of the ring coil or the like under at least a slight pressure. During the upward movement the pressure roller 52 is therefore rotated in the clockwise direction. The winding material 51 is thereby reeled off from the supply roller 50 located ahead of the pressure roller 52, as viewed in the direction of movement, and is pressed against the inner wall 57, for example is adhesively secured thereto by the use of a one-sided self-adhesive tape.

The winding material 51 is so applied that it is pulled off or reeled off from the side of the supply roller 50 opposite the inner wall 57. In particular with the use of a one-sided self-adhesive tape, whose adhesive side on the supply roller 50 points toward the inside, a moment or torque acting in the clockwise direction is exerted thereby on the guide lever 49. As a result thereof, the supply roller 50 is pressed slightly against the inner wall 57 with its flange edge, respectively, the washer disk 55 is pressed slightly against the inner wall 57 with its edge 56. Owing to this measure, additionally a continuous winding off of the winding material 51 from the winding roller is achieved thereby. Simultaneously, the supply roller 50, respectively, the washer disk 55 slides along the inner wall 57 whereby the supply roller 50 is rotated in the counterclockwise direction. With a rotatably mounted pressure roller 55 the latter rolls off with its edge 56 along the inner wall 57 of the ring core 5.

Figure 5:
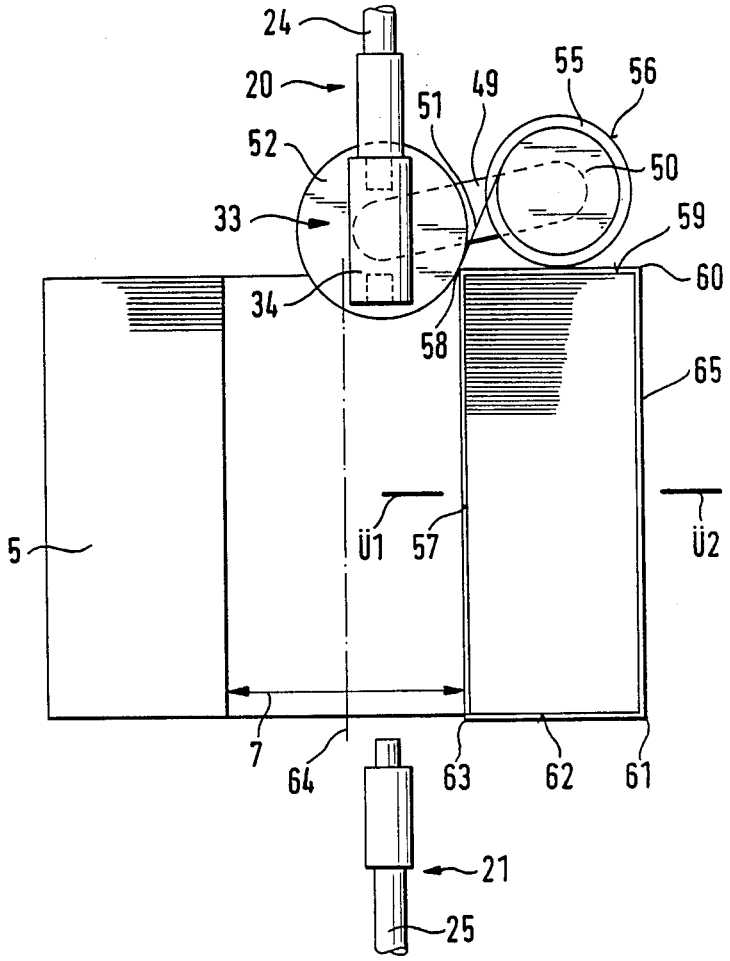

If now, as shown in FIG. 5, the upper transfer mechanism has arrived at the upper inner edge 58 of the ring core 5, then the supply roller 50 is rolled about this inner edge 57 toward the upper end face 59 of the ring core 5 as a result of the aforementioned torque and subsequently also the pressure roller 52 is automatically rolled off in that the upper and preferably at the same time also the lower transfer mechanism 20 and 21 are displaced toward the right and the movement of the transfer mechanism 20 in the upward direction and the movement of the transfer mechanism 21 in the downward direction are stopped.

Figure 6:
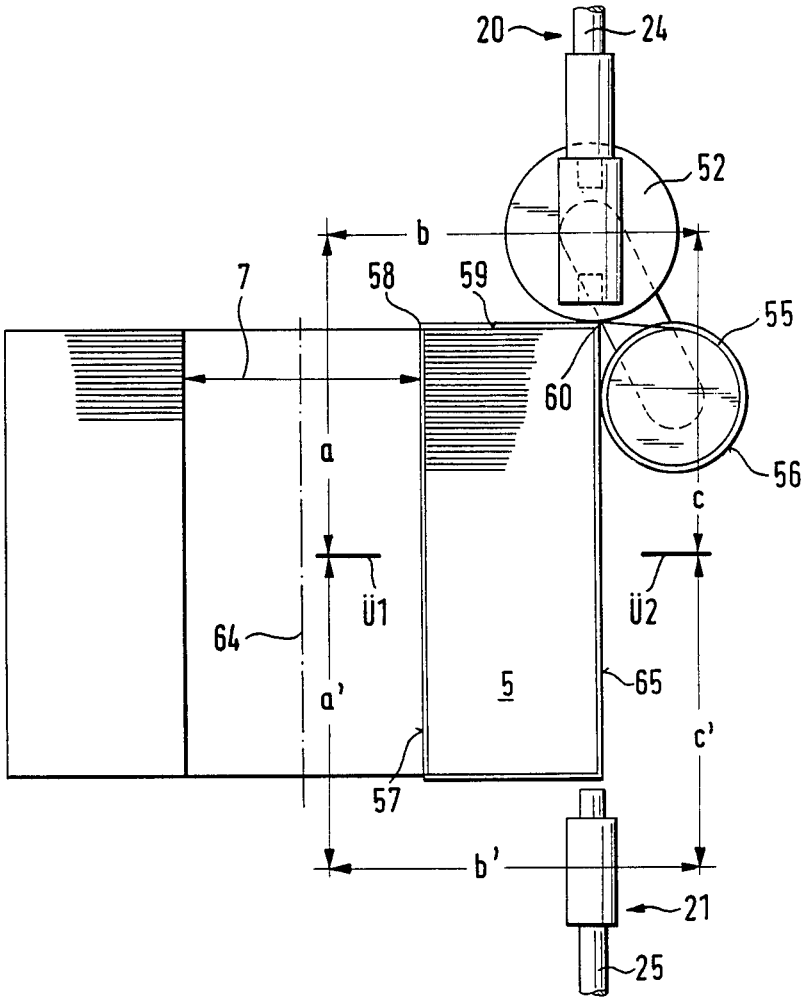
Figure 7:
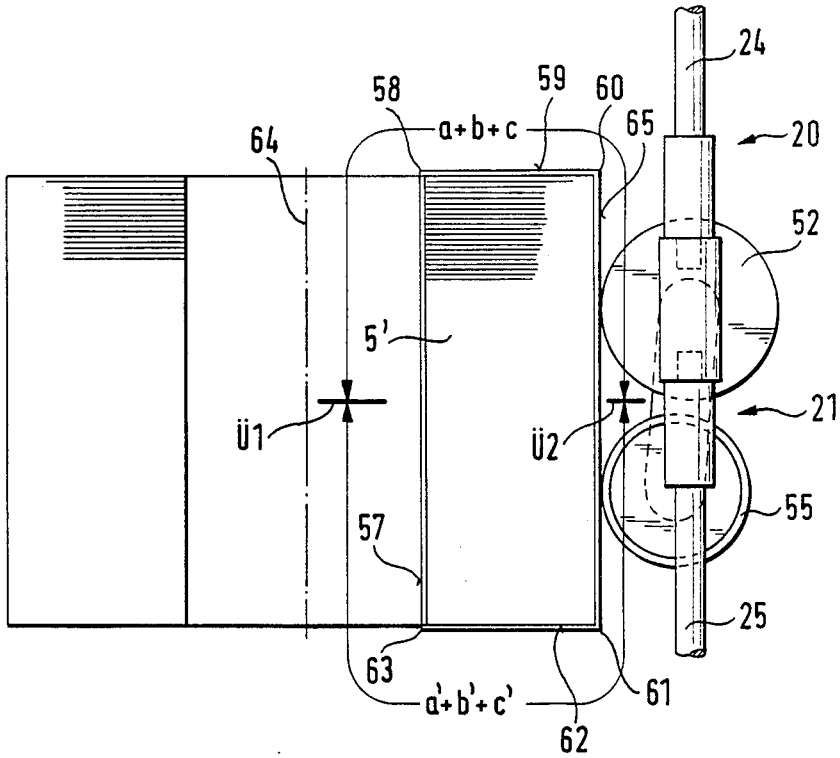

During the further movement of the two transfer mechanisms 20 and 21 toward the right, the deflection operation along the upper outer edge 60 of the ring core 5 repeats itself as illustrated in FIG. 6.

Subsequently, the upper transfer mechanism 20 is moved downwardly and the lower transfer mechanism 21 is moved upwardly and the lateral movement toward the right is stopped. Finally, both transfer mechanisms 20 and 21 reach a second transfer place U2 shown in FIG. 7, at which the lower transfer mechanism 21 is coupled with the carrier body 34 and the upper transfer mechanism 20 is decoupled therefrom. Thereafter both transfer mechanisms 20 and 21 are moved away from one another in that the lower transfer mechanism is moved downwardly and the upper transfer mechanism is moved upwardly. The movement about the lower outer edge 61, along the lower end surface 62 and about the lower inner edge 63 takes place correspondingly as at the upper outer edge 60 respectively at the upper end face 59, only in that the two transfer mechanisms 20 and 21 are now moved toward the left.

Finally, the first transfer place U1 is again reached so that a complete winding of the winding material 51 is now applied on the ring core 5.

As can be readily seen, very long coils respectively ring cores can be wound in this manner because this depends only from a suitable transfer mechanism, in the illustrated embodiment from the length of the rods 24 and 25.

During the winding operation, the transfer mechanisms 20 and 21 are always so guided at a distance from the ring core 5 that a light abutment pressure of the winding material storage unit 33 at the ring core 5 is always possible.

In order to be able to wind the ring core 5 over its entire length, the ring core 5 is rotatably mounted on the support table 4 rotatable about its central axis 64 by an appropriate mechanism of any conventional type such as would be well known to one skilled in the art. FIG. 8 shows such an arrangement with three rollers 91, 92, and 93 with soft edges surrounding a ring core area 98 (shown in dotted lines) and showing a drive 94 for one roller through a transmission element 95. Examples of such well known core rotators can be found in STUTZ U.S. Pat. No. 3,128,955 (see FIG. 2 or in the U.S. Pat. to AVENI No. 2,820,598.) The rotation can thereby take place in such a manner that for example a winding wire is wound on the inner wall 57 without spacing or closely adjacent or in that an insulating or winding tape is thereby so applied that it is wound overlappingly or nonoverlappingly on the outer wall 65.

In order to be able to undertake as rapid a winding as possible, the transfer mechanisms 20 and 21 are so actuated by the adjusting drives 14, 22 and 15, 23 coordinated thereto that they pass through their predetermined travel distances, for example, a, b, c and a', b', c' in the same periods of time. Advantageously the travel distances to be traversed are therefore of equal length and in particular each movement direction is of equal length, i.e. symmetrical with respect to a center line. Preferably the transfer places are therefore provided within the area of the center lines; i.e., for example, respectively in the center of the length of the ring core 5. In the illustrated embodiment this is achieved in that the first transfer place U1 is provided at least approximately in the center inside of the ring core 5 and the second transfer place U2 at least approximately in the center outside of the ring core 5.

Ring cores 5 with respectively small diameter of the ring opening 7 can still be wound by the especially rod-shaped construction of the part of the transfer mechanism 20, 21 having the transfer coupling and by the possible narrow construction of the winding material storage unit.

It is also possible in principle to provide more than two transfer mechanisms, for example one each for the inside and the outside and one each for the upper and lower end face. This arrangement may be advantageous in particular with very large ring cores.

The possibility also exists to provide a multi-coordinate control in lieu of the drive of the transfer mechanisms 20 and 21, respectively, of the transfer couplings 28 and 29 in two coordinates, especially in two mutually perpendicular coordinates.

Hydraulic, electric, pneumatic or mixed drive servos are suited as adjusting drives 14, 15 and 17. Pneumatic drives are particularly advantageous because as a result of the resilient properties thereof the smooth abutment of the pressure roller 52 and/or of the supply roller 50 and/or of the washer disk 55 at the ring core 5 which nonetheless can be as forcible as desired, is readily controllable.

According to one advantageous construction of the present invention, with the use of bayonet couplings the two bayonet slots 42 which are disposed diametrally opposite one another at the carrier body 34 in relation to the rotating shaft 35, are provided mutually oppositely directed so that each rod 24 can be coupled by a right or a left rotation. Both bayonet connections are therefore provided in this case so as to operate to the left or right. In lieu of the bayonet connections also clamping couplings, for example, in the manner of coupling collets or clamping shoes may be provided.

The method according to the present invention and the installation according to the present invention are suitable for every type of winding, insulation, bandaging or the like of ring cores, ring coils, ring core parts or ring coil parts.

The term "ring cores" or "ring coils" is to be understood herein as including cores or coils of any desired geometric arrangement which are closed (endless) or bridged by air gaps. In addition to circular cores and coils, also those having an oval or polyhedrally shaped configuration can be wound, insulated or bandaged.

While we have shown and described only one embodiment in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

I claim:

1. Method for tightly and uniformly winding ring devices having a ring opening such as ring cores with a winding material from a a winding material storage unit means which is initially wound with the winding material and the dimensions of which are smaller than the ring opening of the ring device, by moving the winding material storage unit means through said opening and about the ring device on a rotating roller in a winding direction while continuously and alternately transferring the winding material storage unit means from a first transfer means to a second transfer means and then back again to the first transfer means; comprising the steps of: one, connecting the winding material storage unit to the first transfer means; two, moving the first and second transfer means toward one another to a first transfer place inside of the opening of the ring device; three, disconnecting the winding material storage unit means from the transfer means and connecting it to the second transfer means; four, then moving the two transfer means away from one another; five, moving the second transfer means connected to the winding material storage means in the winding direction at a distance from the ring device while the rotating roller rotates along the ring device with its axis of rotation tangentally aligned to the point of the ring core to be wound and while the winding material is reeled off the winding material storage unit means and wound on the ring device; sixth, at the same time, moving the other transfer means opposite the winding direction until both transfer means are located outside the opening of the ring device; seven, then moving both the transfer means axially outside the ring device into a position relative to one another to cause the rotating roller to rotate on a connecting first front side of the ring device; eight, moving both transfer means toward one another to approach one another at a second transfer place located outside of the ring device; nine, then disconnecting the winding material storage unit from the second transfer means and connecting it back to the first transfer means; ten, then moving the first transfer means at a distance located outside of the ring device in the winding direction with the rotating roller rotating on the outside of the ring device while the winding material continues to reel off from the winding material storage unit means onto the ring device while at the same time, the second transfer means is moved in an unwinding and opposite direction; eleven, after both transfer means are located outside of the ring device in the area over the front side of the ring device, moving both transfer means relative to the ring device into a position where there are axially aligned with the axis of alignment being within the opening of ring device while the rotating roller rotates along a second front side of the ring device and while the winding material continues to unwind and is applied to the second front side of the ring device; twelve, moving both transfer means toward one another to approach the first transfer point; and then repeating the cycle of steps three to twelve until a desired number of windings is wound on the ring device while rotating the ring device continuously or step-by-step about its central axis during the winding process.

2. A method according to claim 1, wherein both transfer means are moved from one transfer place to the other transfer place at a distance from the ring core.

3. A method according to claim 1, wherein both transfer means are moved over a predetermined travel distance at substantially the same time interval.

4. A method according to claim 1, wherein the winding material is transferred from the supply roller to the rotating roller during the winding operation; and wherein the rotating roller presses against the ring core and the winding material comes to lie between the ring core and the rotating roller when the rotating roller presses against the ring core.

5. A method according to claim 1, wherein the winding core storage unit and rotating roller pass through the opening in the ring core device coupled together and one behind the other during the winding operation at least within the ring opening.

6. A method according to claim 5, comprising the step of using a self-adhesive tape as winding material which is wound on the supply roller with the adhesive side facing inwardly and is transferred onto the rotating roller with the adhesive side facing outwardly.

7. An apparatus for winding ring-like parts provided with ring openings with a winding material; comprising: winding material storage means including a supply roller means on which the winding material is wound and which is rotatable secured on a carrier means; said winding storage means having a counter coupling means; the winding material storage means being smaller than the ring opening of the part to be wound; means moving the winding material storage means about the part to be wound in such a manner that the winding material is wound off from the storage means and wound on said ring-like part; said means moving the winding storage means including at least two transfer means; each transfer means having a transfer coupling means; said transfer coupling means operable to engage with and disengage from the corresponding counter-coupling means of the winding material storage means; the moving means including means for moving the two transfer means in at least two coordinates; each transfer means operable to transport the winding material storage means along a part of the circumference of the part to be wound when moved by the moving transfer means; said transfer coupling means transferring the winding material storage means from one transfer means to the other transfer means at two different transfer places the means for moving the transfer means are operable to: (1) move the transfer means along one coordinate and oppositely from the one transfer place, (2) move the transfer means in the same direction along the other coordinate; and (3) being able to move the transfer means towards one another at the second transfer place; the transfer coupling means coupling one transfer means to the winding material storage means while decoupling the other transfer means therefrom at one transfer space while decoupling the material storage means from the one coupling mean and coupling the material storage means at the other transfer space; the coupling means coupling the material storage means to that transfer means which is being driven in the winding direction.

8. An apparatus according to claim 7, wherein the means moving the transfer means move the transfer means substantially parallel to the central axis of said ring-like part and transversely in the direction to the ring-like part toward and away from the same.

9. An apparatus according to claim 8, wherein the means moving the transfer means moves each transfer mean in equal travel lengths for each complete winding.

10. An apparatus according to claim 9, wherein the travel lengths with respect to the imaginary connecting line between the transfer place are constructed mirror-image-like symmetrical and the one transfer means is operable to transverse its coordinated travel distance opposite to and at the same time with the other transfer means.

11. An apparatus according to claim 10, wherein one transfer place is located outside and the other transfer place is located inside the part to be wound, each at least approximately in the center of the length thereof.

12. An apparatus according to claim 7, wherein the carrier means includes a carrier member, a rotating shaft arranged perpendicular thereto, and one counter-coupling means each at two diametrically opposite places with respect to the shaft.

13. An apparatus according to claim 12, wherein a further carrier member which is rigidly secured at the end of the shaft, is provided at opposite places with at least one position-fixing means and wherein position fixing moving means bring the one position-fixing means into operative connection with a complementary position-fixing means operatively connected with the transfer means.

14. An apparatus according to claim 12, further comprising a guide lever pivotally mounted on the shaft, a supply roller means and a pressure roller means rotatably supported on said guide lever, the axis of the supply roller means being spaced further away from said shaft than the axis of the pressure roller means.

15. An apparatus according to claim 14, wherein the pressure roller means is supported on said shaft.

16. An apparatus according to claim 14, wherein a washer is rotatably arranged on a flange side of the supply roller means.

17. An apparatus according to claim 14, further comprising a lateral washer disk on a flange side of the supply roller means which at least along the edge thereof consists of a material with low coefficient of friction.

18. An apparatus according to claim 17, wherein the lateral washer disk is formed by the flange side of the supply roller means itself.

19. An apparatus according to claim 17, wherein the washer disk is mounted on a flange side of the supply roller means.

20. An apparatus according to claim 7, wherein the transfer coupling means is located on each transfer means on a rod having an end facing the part to be wound.

21. An apparatus according to claim 20, wherein the rod of each transfer means is arranged substantially in the direction of the central axis of said ring-like part and substantially perpendicular thereto and wherein there are means for positioning the rod along its axis.

22. An apparatus according to claim 7, wherein the means for moving the transfer means are adjustable by way of servo-drive means.

23. An apparatus according to claim 7, wherein the coupling means between the transfer means and the carrier means includes a bayonet-like connection, means rotating the rods of the transfer means in a closing and opening direction about their longitudinal axis.

24. An apparatus according to claim 23, wherein the bayonet-like connections are provided oppositely directed, as viewed in the longitudinal direction from a side to be operable in the same direction.

25. An apparatus according to claim 7, wherein the coupling means include a clamping connection between the transfer means and the carrier means.

26. An apparatus according to claim 25, wherein the clamping means is constructed in the manner of a clamping collet including a spreadable sleeve at a rod end and a corresponding bore provided in the carrier means.

27. An apparatus for winding ring-like parts provided with a ring opening with a winding material, comprising: winding material storage means for initially storing the winding material; means subsequently moving the winding material storage means about the core part so as to wind-off the winding material from the storage means and winding the same on the ring-like part; the winding material storage means having dimensions smaller than the ring opening in the ring-like part and being operable to be moved through the ring opening as a structural unit; means for moving the winding material storage means about the part to be wound including first transfer means and second transfer means; means for alternately transferring the storage means from the first transfer means to the second transfer means; the means for moving the winding storage means including: a first means for moving the transfer means toward one another, a means for actuating the means for alternately transferring the winding material storage means at a first transfer place from the first to the second transfer means, subsequent moving means for subsequently moving the transfer means away from one another while the second transfer means carrying the winding material storage means is moved in the winding direction at a distance from the part to be wound; the winding material storage means rolling off along the part to be wound and to wind the winding material from off the winding material storage means and onto the part to be wound; further moving means for moving the first transfer means at the same time opposite the winding direction toward the second transfer place; subsequent moving means moving both transfer means to approach one another in a second transfer place; second actuating means for actuating the means for alternately transferring the winding material storage means to the first transfer means in the second transfer place, additional moving means to move the first transfer means in the winding direction at a distance to the part to be wound in such a manner that the winding material storage means continues to roll off along the ring-like part and the winding material is thereby continued to be wound off from the winding material storage means and wound on the part to be wound; and last moving means for moving the second transfer means simultaneously opposite the winding direction along the part to be wound toward the first transfer place.

28. An arrangement for winding ring devices having an opening with a winding material, a winding material storage unit means having a storage roller with winding material wound thereon and which is smaller than said opening in the ring device; two transfer means that are arranged on a joint axial line at a distance from one another and means for rigidly connecting the winding material storage unit to the two transfer means alternately; means for changing the position of the joint axial line from a position in which the line is located inside the ring device to a position in which the line is located outside the ring device to wind the winding material on the ring device by the alternating guiding of the winding material storage unit by one or the other of the two transfer means with the changing of the position of the line from inside to outside the ring device; the winding core storage unit always rigidly connected with one of the transfer means; means to move both transfer mechanisms toward one another to transfer places when the axial line extends inside or outside the ring device; and whereat one transfer means is connected to the winding material storage unit while the other transfer mechanism is disconnected from the winding material storage unit; the winding material storage unit roller being tangential with respect to a place on the ring device to wound; and means for rotating the ring device around its central axis.

29. An apparatus according to claim 28, further comprising frame means, support arm means on the frame means, support table means mounted on said support arm means and means for adjusting the support table means along the support arm means, one support means each at the end of each of the support arm means, said support means extending substantially perpendicularly to the support arm means, support column means, means to adjust the support column in the support arm means in a direction substantially perpendicular to the support arm means, adjustable means for adjustable attaching one of said transfer means at the ends of the support columns in a direction parallel to the support arm means.

30. An apparatus according to claim 29, wherein the means to adjust each support column has its own adjusting drive.

31. An apparatus according to claim 29, wherein the two support columns are rigidly connected with each other by way of a connecting web.

32. An apparatus according to claim 31, wherein there are additional adjusting means to adjust the rigid connection.

* * * * *